United States Patent [19]

Lau et al.

[11] Patent Number: 4,697,518

[45] Date of Patent: Oct. 6, 1987

[54] MOLDED FIREWORKS

[75] Inventors: Nam S. Lau; Yick J. Lau, both of Hong Kong, Hong Kong

[73] Assignee: Phantom Firework Manufacturing Company Limited, Hong Kong

[21] Appl. No.: 11,071

[22] Filed: Feb. 5, 1987

[51] Int. Cl.[4] ..... F42B 4/00

[52] U.S. Cl. ..... 102/358; 102/361; 102/530; 86/20.11

[58] Field of Search ..... 102/358, 361, 530; 86/20.11

[56] References Cited

U.S. PATENT DOCUMENTS

| | | | |
|---|---|---|---|
| 1,886,407 | 11/1932 | Kohn | 102/361 |
| 3,678,855 | 7/1972 | Semel | 102/361 X |
| 4,025,289 | 5/1977 | Duncan et al. | 102/358 |
| 4,052,940 | 10/1977 | Gits et al. | 102/361 |
| 4,495,868 | 1/1985 | Matthews | 102/360 X |
| 4,566,388 | 1/1986 | Loyd, Jr. | 102/361 |

FOREIGN PATENT DOCUMENTS 2506865 8/1976 Fed. Rep. of Germany ..... 86/20.11

*Primary Examiner*—Peter A. Nelson

*Attorney, Agent, or Firm*—Caesar, Rivise, Bernstein, Cohen & Pokotilow, Ltd.

[57] ABSTRACT

A pyrotechnic device having a maximum explosive effect with a minimum quantity of explosive composition. The device is in the form of a polyurethane plastic foam body molded about a firecracker tube. The firecracker tube contains a small explosive composition charge therein and into which a fuse extends. The tube is sealed at each end by packing means. A polyurethane sealant coating is provided over the tube to seal any openings in the tube and any openings in any interface between the tube, the packing means and the fuse. The sealant serves as a good engaging surface to which the body portion of plastic foam will adhere when molded. When completed, the plastic foam body has a predetermined shape, such as cylindrical, generally spherical, or multifaceted.

10 Claims, 3 Drawing Figures

MOLDED FIREWORKS

BACKGROUND OF THE INVENTION

This invention relates generally to methods of manufacturing fireworks and the fireworks produced thereby.

As will be appreciated, the technology involved in fireworks is a very old one. Most fireworks basically include some explosive charge, e.g., flash powder, sealed within a body, and which is ignited by some means, e.g., a fuse. Examples of various types of fireworks are shown in U.S. Pat. Nos. 321,833 (Masten); 619,177 (Hinton); 1,789,372 (Scardone); 1,792,246 (Rutter et al.); 1,886,407 (Kohn); 1,914,607 (Kohn); 2,022,770 (Kann); 2,034,976 (Decker); and 2,130,068 (Cimorosi).

Other types of prior art fireworks, such as those pyrotechnic devices known as "cherry bombs", have traditionally been formed by locating a firecracker or an explosive charge within a sawdust and binder body which may or may not be covered with a plastic shell.

Until several years ago, consumer fireworks have included a substantial charge of flash powder, e.g., 500 milligrams or more. Then the federal government established regulations regarding firecrackers to be sold to the public. In this connection, the amount of explosives in fireworks to be sold to the public is now restricted to a maximum of 50 milligrams (approximately 0.772 grains of powder). While such federal regulations have increased the safety factor to the public, the reduction in allowed explosives has sharply curtailed the amount of noise and the explosive effect produced by such fireworks. Thus, it has been suggested, such as in the patent literature, to produce fireworks containing the small legal limit charge, but which are constructed to still produce a loud noise (report) with a substantial explosive effect. Examples of such devices are shown in U.S. Pat. Nos. 4,052,940 (Gits et al.) and 4,566,388 (Lloyd, Jr.).

Unfortunately, the need still exists for firecrackers which can simulate those produced prior to the stringent requirements limiting the explosive charge.

OBJECTS OF THE INVENTION

Thus, it is a general object of the instant invention to provide a pyrotechnic device which overcomes the disadvantages of the prior art.

It is still a further object of the instant invention to provide a pyrotechnic device which simulates the size, shape and effects of prior art devices but with a legally acceptable quantity of explosives therein.

It is still a further object of the instant invention to provide a pyrotechnic device which is safe to use so that when it explodes no sharp fragments or shrapnel are produced.

It is still a further object of the instant invention to provide a pyrotechnic device which is simple in construction and can be fabricated at a relatively low cost.

SUMMARY OF THE INVENTION

These and other objects of the invention are achieved by providing a pyrotechnic device having a maximal explosive effect with a minimum quantity of explosive composition therein. The device basically comprises a body portion formed of a plastic foam material and having a hollow tube disposed therein. The tube contains an explosive composition and into which an elongated fuse extends. Packing means are provided to enclose the explosive composition within the tube. A coating, such as of a polyurethane sealant, is provided over the tube to seal any openings therein and any openings in the interface is between the tube, the packing means and the fuse. The sealant coating also provides a surface about which the plastic foam body is molded. Once molded, the plastic foam body has a predetermined shape.

DESCRIPTION OF THE PREFERRED EMBODIMENT OF THE INVENTION

Figure 1:
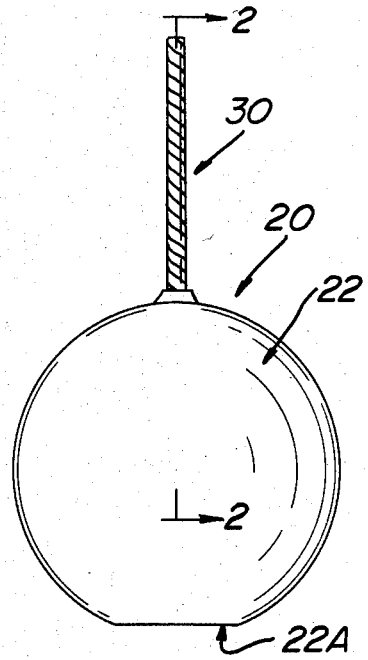
FIG. 1 is a side elevational view of an exemplary pyrotechnic device constructed in accordance with this invention.
Figure 2:
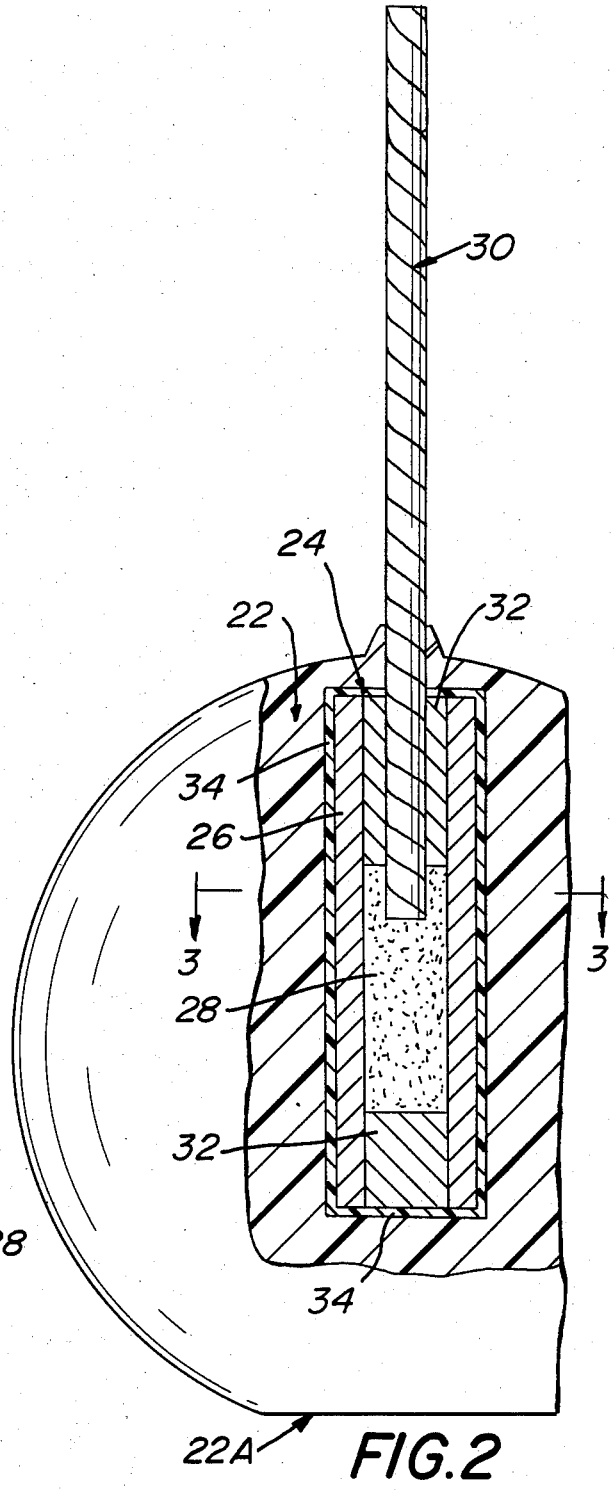
FIG. 2 is an enlarged side elevational area taken along line 2—2 of FIG. 1 and being partially in section.
Figure 3:
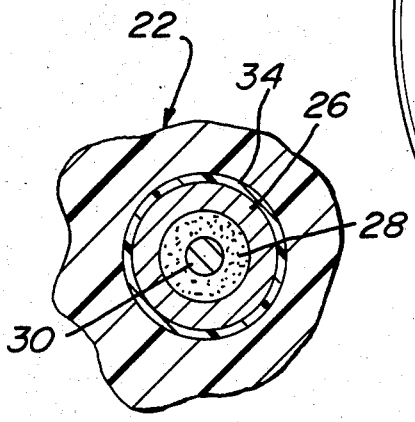
FIG. 3 is a sectional view taken alonng lines 3—3 of FIG. 2.

Referring now in greater detail to the various figures in the drawing wherein like reference characters refer to like parts, there is shown generally at 20 in FIG. 1 a pyrotechnic device constructed in accordance with the instant invention. The device 20 basically comprises a body 22 molded of a plastic material in situ about a conventional type firecracker.

It should be pointed out at this juncture that the body portion 22, while shown herein as being of generally spherical shape, except for a flatted base portion 22A, can be of any other suitable shape, such as a cylinder, a cone, or a multiplanar faced construction (i.e., a multifaceted member). Moreover, since the body 22 is molded, the outer surface thereof can be smooth, grooved or have any other surface features desired thereon.

As can be seen, the firecracker 24 basically comprises a tubular shell 26 formed of any suitable material, such as paper. The outer diameter of the shell is small, e.g., 10 mm, and its length is also somewhat short, e.g., approximately 30 mm. Disposed within the hollow interior of the paper tube 26 is an explosive composition, such as conventional flash powder 28. The quantity of flash powder contained within the tube 26 preferably does not exceed the legal limits, e.g., 50 milligrams. A conventional safety fuse 30 extends into the tube 26 and the flash powder 28 located therein. The tube is sealed at its upper and lower ends by plugs 32 formed of conventional materials, such as clay.

In accordance with the preferred aspect of this invention, disposed over the outer surface of the tube 26, the outer surface of the plugs 32 and the interface between the tube 26, plugs 32 and fuse 30 is a coating 34 formed of a plastic sealant. One particularly effective sealant is a conventional polyurethane sealant which is applied at a thickness of 0.3 mm.

The polyurethane sealant coating 34 serves two valuable functions. Firstly, by sealing any openings in the firecracker 24 through which the gases produced by the explosion could vent, the explosive charge is hence constricted or confined, thereby maximizing the noise and explosive effect produced by the explosion. Secondly, the coating 34 serves as surface to which the polyurethane foam of the body 22 adheres when the plastic material making up the body portion is molded in situ thereabout. Thus, the body 22 permanently encases therein the firecracker 24, with the fuse 26 extending thereout as shown in FIG. 1.

In accordance with the preferred embodiment of the invention, the material forming the body 22 is a plastic foam, such as a closed cell polyurethane foam sold by Universal Foam Systems, Inc. of Cudahy, Wis., under the designation "Versi-Foam".

Fabrication of the device 20 is as follows. The firecracker 24 with its fuse 30 is formed in a conventional manner and thereafter coated with the sealant 34. The coated firecracker is then disposed in a mold cavity (not shown) and the plastic forming the body portion 22 is introduced therein so that it is molded about the firecracker, with the fuse extending therefrom. The resulting device 20 is then removed from the mold cavity and is ready for packaging and/or subsequent use.

As should be appreciated from the foregoing, pyrotechnic devices constructed in accordance with the instant invention can utilize a small, legal amount of explosive charge, while still producing a loud noise with a substantially explosive effect. Moreover, the lightweight nature of the foam body 22 ensures that the body 22 does, in fact, explode into a multitude of fragments, all of which are soft and light, and thus present no danger to persons in the vicinity.

Without further elaboration, the foregoing will so fully illustrate our invention that others may, by applying current or future knowledge, adopt the same for use under various conditions of service.

We clalm:

1. A pyrotechnic device having a maximal explosive effect with a minimum quantity of an explosive composition comprising a body portion formed of a plastic foam material and a hollow tube disposed within said body portion, said tube containing an explosive composition therein and into which an elongated fuse extends, packing material enclosing said explosive composition within said tube and sealing means in the form of a coating covering said tube for sealing any openings therein and any openings in the interfaces between said tube, said packing means and said fuse, said sealing means providing a surface to which said plastic foam body is molded, said plastic foam body having a predetermined outer shape.

2. The pyrotechnic device of claim 1 wherein said sealing means comprises a plastic composition.

3. The pyrotechnic device of claim 2 wherein said plastic composition comprises polyurethane.

4. The pyrotechnic device of claim 3 wherein said plastic foam body comprises polyurethane.

5. The pyrotechnic device of claim 1 wherein said body is cylindrical.

6. The pyrotechnic device of claim 1 wherein said body is generally spherical.

7. The pyrotechnic device of claim 1 wherein said body includes a plurality of generally planar faces.

8. The pyrotechnic device of claim 1 wherein said tube is formed of paper, said plastic foam is polyurethane foam and said sealing material comprises polyurethane sealant.

9. A method of making a pyrotechnic device comprising providing a polyurethane sealant on the surface of a firecracker body having a fuse so that said sealant closes any openings in said firecracker body and at the interface with the fuse, and thereafter molding an enlarged body portion of a plastic foam about said sealant coated firecracker body to form a pyrotechnic device having a predetermined enlarged shape.

10. The method of claim 1 wherein said sealant used is a polyurethane sealant and wherein said plastic foam used is a polyurethane foam.

* * * * *